United States Patent [19]

Satoh et al.

[11] Patent Number: 4,905,051

[45] Date of Patent: Feb. 27, 1990

[54] FIXING MEANS FOR ELECTROPHOTOGRAPHIC COPIER

[75] Inventors: Fumio Satoh, Habikino; Yoichi Shimazawa, Nara; Yasuhiro Takai, Sakurai; Katsumi Nakanishi, Yamatokoriyama, all of Japan

[73] Assignee: Sharp Kabuhsiki Kaisha, Osaka, Japan

[21] Appl. No.: 249,231

[22] Filed: Sep. 23, 1988

Related U.S. Application Data

[63] Continuation of Ser. No. 135,548, Dec. 18, 1987, abandoned, which is a continuation of Ser. No. 830,125, Feb. 18, 1986, abandoned.

[30] Foreign Application Priority Data

Mar. 12, 1985 [JP] Japan ..... 60-49523
Mar. 12, 1985 [JP] Japan ..... 60-49524
Mar. 25, 1985 [JP] Japan ..... 60-62720

[51] Int. Cl.[4] ..... G03G 15/20

[52] U.S. Cl. ..... 355/290; 355/282; 355/285; 219/216

[58] Field of Search ..... 355/3 FU, 3 SH, 14 FU, 355/14 SH, 14 R, 282, 285, 289, 290; 219/216, 469–471

[56] References Cited

U.S. PATENT DOCUMENTS 3,916,146 10/1975 Hutner ..... 219/216
3,937,921 2/1976 Furuichi et al. ..... 219/216 X
4,009,953 3/1977 Ravizza et al. ..... 219/216 X
4,373,801 2/1983 Itoh ..... 355/3 FU X
4,385,826 5/1983 Itoh ..... 355/14 FU
4,609,278 9/1986 Taniguchi ..... 355/3 FU
4,642,448 2/1987 Shigemura et al. ..... 355/3 FU X
4,671,643 6/1987 Shigemura et al. ..... 355/14 FU X

FOREIGN PATENT DOCUMENTS 59175 1/1984 Japan ..... 355/14 FU

*Primary Examiner*—A. C. Prescott
*Attorney, Agent, or Firm*—Flehr, Hohbach, Test, Albritton & Herbert

[57] ABSTRACT

A fixing means for an electrophotographic copier includes a first roller and a second roller which are compressed against each other and serve to fix toner images on an image transferring medium passed therebetween. A control means is programmed to operate the rollers such that the heating of the second roller is continued for a predetermined length of time or until the surface temperature of the second roller reaches a certain predetermined temperature level after the surface temperature of the first roller reaches another predetermined temperature level such that the second roller is prevented from cooling down suddenly after the fixing operation is started. In another aspect of the present invention, the size of the image transferring medium passed between the rollers is detected and the heaters for the rollers are controlled accordingly such that temperature variations on the roller surfaces can be reduced and hence the roller lifetimes can be improved.

6 Claims, 4 Drawing Sheets

FIXING MEANS FOR ELECTROPHOTOGRAPHIC COPIER

Which is a continuation of application Ser. No. 830,125 filed Feb. 18, 1986, now abandoned.

This invention relates to a fixing means for an electrophotographic copier and more particularly to such a fixing means adapted to fix toner images by causing a medium with toner images to pass between a heat roller and a contact roller.

Most electrophotographic copiers make use of the so-called thermal fixing method or heat roller fixing method to fix toner images formed on an image transferring medium (hereinafter simply referred to as a copy paper). According to this method, the on which toner images are formed is passed between a heat roller and a contact roller compressed against it, and the heat roller is heated prior to the fixing operation for a predetermined period of time until the surface temperature of the heat roller reaches or exceeds the melting point of the toner images or otherwise a level at which the desired fixing process can be properly carried out. The prior art method of determining this preheating time period, however, frequently proves to be unsatisfactory when a large number of copies must be made by a high-speed operation. This is because, although the surface temperature of the heat roller may have reached a predetermined level by the preheating process, heat is immediately transferred away therefrom and the temperature of the fixing means drops below the required level for a successful fixing operation.

In FIG. 11 which illustrates how a situation described above may come about, curves $T'_H$ and $T'_C$ show how the temperatures of the heat roller and the contact roller may typically change with time in a prior art fixing means. According to a prior art preheating method represented by FIG. 11, power is switched on at time $t'_1$ and the roller temperatures gradually increase. When the temperature of the heat roller reaches a predetermined level $a'_1$, the so-called first preheating period ends and a second preheating period is started immediately. In FIG. 11, this switch-over time is indicated by $t'_2$ and the temperature of the contact roller at this time is indicated by $b'_1$. During the second preheating period, heat flows from the heat roller to the contact roller at an increased rate. The end of the second preheating period is reached when the temperature of the heat roller reaches another predetermined level $a'_2$. The end time of the second preheating period is indicated by $t_3$ and the temperature of the contact roller at this time is shown by $b'_2$. After the end of the second preheating period, the temperature of the contact roller drops rapidly (down to a level indicated by $b'_3$ in FIG. 11). This increases the rate of heat transfer from the heat roller to the contact roller and a large amount of electric power must be supplied to the heat roller in order to maintain the fixing means at a sufficiently high temperature level for fixing operations.

Another problem to be considered with a conventional electrophotographic copier of the type described above relates to situations where a copy paper of less than the maximum size is passed between the rollers because the heating means for a conventional fixing means is usually adapted to generate heat at a fixed rate such that fixing can be appropriately effected when a copy paper of the maximum size admissible by the rollers is passed through. Thus, if a copy paper of the maximum size is passed between the rollers, the surface temperatures of the rollers will go down uniformly since the width of the paper and that of the rollers coincide approximately. If a smaller copy paper is passed through, however, there results a large temperature difference on the roller surfaces as illustrated in FIG. 12 which represents a situation where the roller width $W_R$ is greater than the paper width $W_P$ so that the surface temperature $T_2$ where the paper has passed is much lower than the surface temperature $T_1$ where the paper has not passed. In the past, there was the tendency to set the temperature $T_1$ higher than necessary so that a copy paper of even the maximum size can be properly fixed. This has the consequence of making the local temperature differences $T_1-T_2$ significantly large when a copy paper of a smaller size is used. As a result, possibilities of local deformations (expansion, swelling, etc.) of the roller surfaces (for example, of silicone rubber), separation of rubber materials from the cores of the rollers, wrinkles resulting on the copy papers and uneven fixing have to be seriously considered.

It is therefore an object of the present invention to provide a fixing means for an electrophotographic copier by the heat roller fixing method using a heat roller and a contact roller such that the contact roller can be sufficiently heated.

It is another object of the present invention to provide a fixing means for an electrophotographic copier by the heat roller fixing method such that the useful lives of the rollers can be improved and high quality copying can be effected.

The above and other objects of the present invention are achieved by providing a fixing means for an electrophotographic copier by the heat roller fixing method using a heat roller and a contact roller such that the contact roller is caused to rotate by the rotation of the heat roller after the heat roller has reached a predetermined temperature level adequate for fixing operations and that the temperature of the heat roller is transmitted to the contact roller by this rotary motion. According to another embodiment of the present invention, a control means is provided for a heating means based on the surface temperature of the contact roller such that the preheating process is completed after the surface temperature of the heat roller reaches a first predetermined level when the surface temperature of the contact roller reaches a second predetermined level. The surface temperature of the contact roller can thus be prevented from dropping suddenly to create a situation where proper fixing operations cannot be continued. In another aspect of the present invention, a means is provided for detecting the size of the copy paper being passed between the rollers and the heating means for the rollers is controlled on the basis of the result obtained by the detecting means.

The accompanying drawings, which are incorporated in and form a part of the specification, illustrate embodiments of the present invention and, together with the description, serve to explain the principles of the invention.

Figure 1:
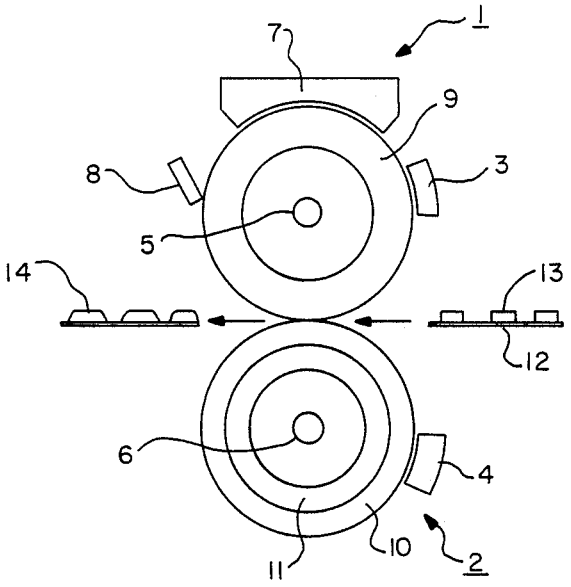
FIG. 1 is a diagram showing the structure of a fixing means for an electrophotographic copier embodying the present present invention.

The structure of a fixing means embodying the present invention is schematically shown in FIG. 1 wherein numerals 1 and 2 generally indicate a heat roller and a contact roller, respectively. These rollers 1 and 2 may be adapted to become compressed against each other with a predetermined pressure therebetween only after the power source for the electrophotographic copier is switched on or they may be in this mutually engaged relationship independently of whether the power source is on or off. The heat roller 1 includes a thermister 3 disposed in contact with the surface thereof, a heat generating means 5 such as a halogen lamp disposed inside thereof, a felt piece 7 impregnated with silicone oil, a blade 8 and a teflon-coated roller 9. The contact roller includes a thermister 4 disposed in contact with the surface thereof, a heat generating means 6 such as a halogen lamp disposed inside thereof, a rubber roller 10 impregnated with silicone oil and a core piece 11. A copy paper 12 with unfixed toner images 13 is passed between the rollers 1 and 2 and comes out with fixed toner images 14 to be delivered to an ejection tray (not shown) by a known paper-ejecting means (not shown).

Figure 2:
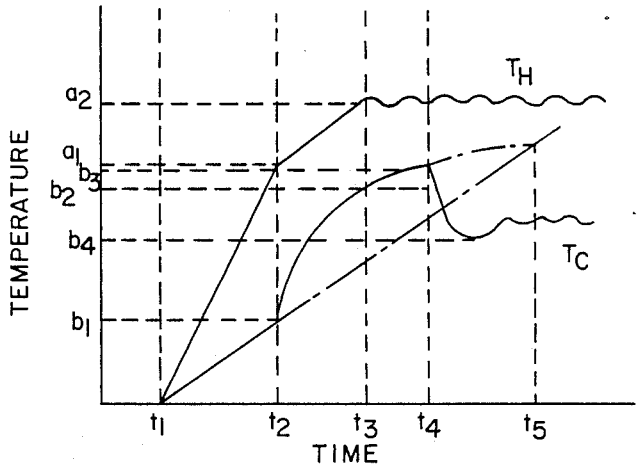
FIG. 2 is a graph which schematically shows the changes in the surface temperatures of the rollers in the fixing means of FIG. 1 embodying the present invention.

According to an embodiment of the present invention, the fixing means shown in FIG. 1 is operated in such a manner that the surface temperatures $T_H$ and $T_C$ of the heat roller 1 and the contact roller 2, respectively, will change with time as shown in FIG. 2. Reference being made to FIG. 2, power is switched on at time $t_1$ and the time interval from $t_1$ to $t_2$ represents the first stage of the preheating period. Likewise, the time interval between $t_2$ and $t_3$ represents the second stage (of duration about one minute) and the time interval between $t_3$ and $t_4$ represents the third stage of the preheating period according to this embodiment of the present invention. As shown in FIG. 2, the surface temperatures of the rollers 1 and 2 are $a_1$ and $b_1$, respectively, at the end of the first stage ($t_2$), $T_H=a_2$ and $T_C=b_2$ at the end of the second stage ($t_3$), and $T_H$ is approximately equal to $a_2$ and $T_C=b_3$ at the end of the third stage ($t_4$).

The rotary motions of the rollers 1 and 2 are controlled on the basis of the temperatures $a_1$ and $a_2$. In other words, the surface temperature of the heat roller 1 begins to rise when the power source is switched on and the first stage of preheating is ended when $T_H$ reaches $a_1$. When the first stage comes to an end at $t_2$, both the heat roller 1 and the contact roller 2 begin to rotate by operations of a main motor (not shown in FIG. 1). The rollers continue to rotate until the surface temperature $T_H$ of the heat roller 1 reaches $a_2$ at which fixing operations can be properly effected, and the second stage of preheating ends.

Thereafter, the heat generating means 5 inside the heat roller 1 is switched on and off intermittently, controlled by the thermister 3, to maintain the surface temperature of the heat roller 1 approximately equal to $a_2$. When the main motor begins to operate, electric circuits of various high-voltage sections, etc. inside the copier also become active. In view of the total rate of power consumption by the copier, the heat generating means 6 inside the contact roller 2 is switched off at this moment.

This embodiment of the present invention is characterized in that the main motor is programmed to resume its rotation for a specified length of time after the end of the second stage of preheating when the surface temperature of the heat roller 1 reaches $a_2$. In FIG. 2, this specified length of time immediately after the conclusion of the second stage is identified as the third stage from $t_3$ to $t_4$. The purpose of keeping the main motor rotating for this additional time period is to significantly reduce the temperature drop on the surface of the contact roller 2 after the fixing means becomes ready to start the fixing operation. Experiments have shown that as the time interval from $t_3$ to $t_4$ is changed from two minutes to three minutes and further to four minutes, the surface temperature $b_3$ of the contact roller 2 at the end of the third stage changes relatively little in the range of 170 to 180° C. but the level $b_4$ to which the surface temperature of the contact roller 2 drops after the main motor is switched off at the end of the third stage becomes 50°, 40° and 35° C., respectively. This is because heat is additionally supplied from the heat roller 1 to the contact roller 2 over an extended time during which the rollers 1 and 2 are kept rotating and this has the effect of reducing the difference between the surface temperatures of the contact roller 2 and the inside temperature.

Figure 3:
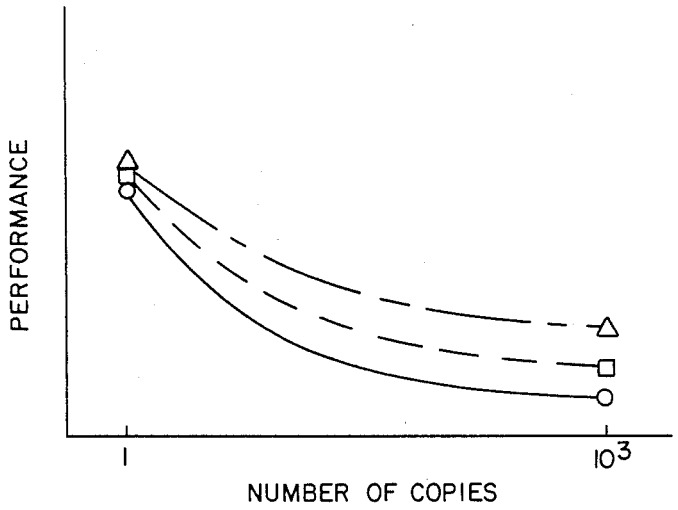
FIG. 3 is a graph which shows the improved performance characteristics of the fixing means of FIG. 1 according to one embodiment of the present invention.

The effects of additional heating described above are demonstrated in FIG. 3 wherein the fixing performance is shown as a function of the number of processed copy papers. The curve between two circles indicates a situation where the additional heating takes place for two minutes (from $t_3$ to $t_4$). The curve between two two minutes (from $t_3$to $t_4$). The squares represents the case where the additional heating period is three minutes and the curve between two triangles represents the case where the additional heating period is four minutes. FIG. 3 shows that the fixing performance improves as the length of additional heating (the third stage) is made longer.

Figure 4:
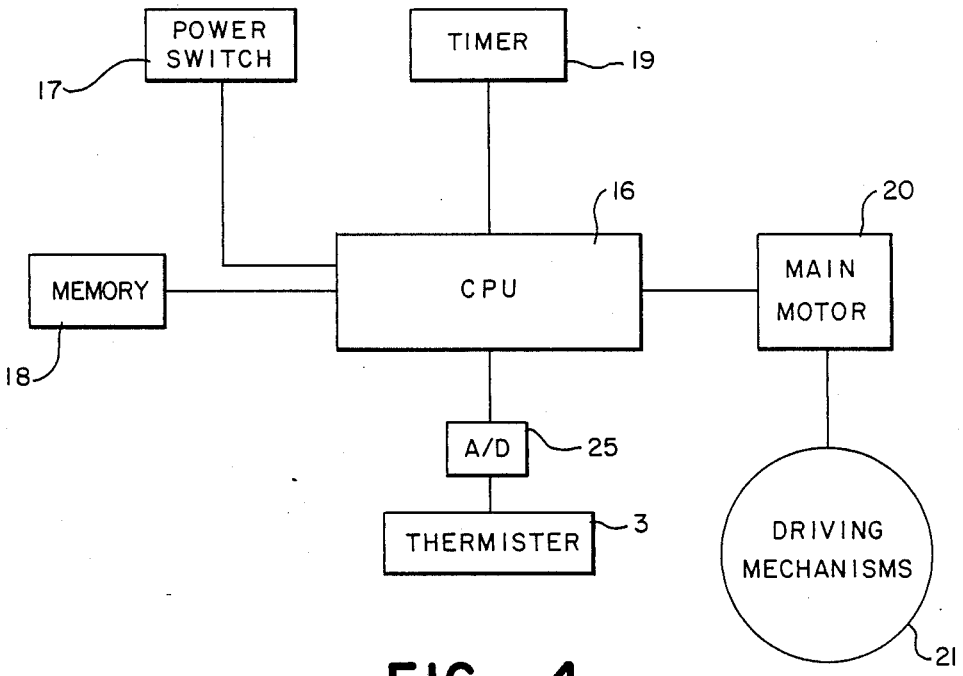
FIG. 4 is a block diagram of a control system for operating the fixing means of FIG. 1.

FIG. 4 is a block diagram of a circuit for operating the fixing means of FIG. 1 according to the mode described above and illustrated in FIGS. 2 and 3. Reference being made to FIG. 4, numeral 16 indicates a central processing unit CPU to which the measured temperature value by the thermister 3 in contact with the heat roller 1 of FIG. 1 is transmitted through an analog-to-digital converter A/D 25. The CPU 16 is adapted to control the motion of the aformentioned main motor 20, causing it to start rotating when the power switch 17 is set in the ON position. Numeral 21 generally indicates the mechanisms for driving the rollers 1 and 2. The CPU 16 is further adapted to compare the temperature detected by the thermister 3 with the predefined temperature $a_2$ stored in a memory means 18 and to start a timer 19 from the point in time when they become equal to each other. The main motor 20 is rotated until the timer 19 shows that a time interval corresponding to another predefined value stored in the memory means 18 has passed. As explained above, the aforementioned rollers 1 and 2 are caused to rotate by the motion of this main motor 20.

In summary, there is added to a fixing means of a conventional type a heating means for heating the contact roller by the rotation of the heat roller after the surface temperature of the latter reaches a level sufficiently high for fixing operations. As a result, the heat flow from the heat roller to the contact roller is reduced after the condition for starting fixing operations has been established. This prevents the undesirable temperature drop in the fixing means and the fixing performance is improved especially for a copier operated at a high speed or when a large number of sheets are processed. Since the temperature of the fixing means can be maintained merely by rotating the heat roller, furthermore, the present invention also has the effect of reducing power consumption.

Alternatively, the preheating process may be programmed in part on the basis of the surface temperature of the contact roller, reference being made again to the fixing means described in FIG. 1. Such a preheating program according to a second embodiment of the present invention is similar to the one described above and will be explained below with reference again to FIG. 2. According to the embodiment of the present invention, the end of the third stage of preheating is not determined by the predefined time interval represented by $t_4-t_3$ but instead by the temperature level $b_3$ to which the contact roller 2 must reach. To summarize, the first stage of preheating lasts until the surface temperature of the heat roller 1 as detected by the thermister 3 reaches a predetermined level $a_1$ with the main motor remaining in the OFF condition and both heat generating means 5 and 6 being switched on; the second stage of preheating starts at $t_2$ and lasts until the surface temperature of the heat roller 1 reaches a higher predetermined level $a_2$ with the main motor and the heat generating means 5 for the heat roller 1 switched on but the heat generating means 6 for the contact roller 2 switched off as explained above in connection with the first embodiment of the present invention in view of the increased rate of total power consumption during this period caused by the operation of the main motor; and the third stage starts at $t_3$ and lasts until the surface temperature of the contact roller 2 as detected by the thermister 4 reaches a predetermined level $b_3$ higher than the surface temperature $b_2$ of the contact roller 2 at the end of the second stage of preheating.

Figure 5:
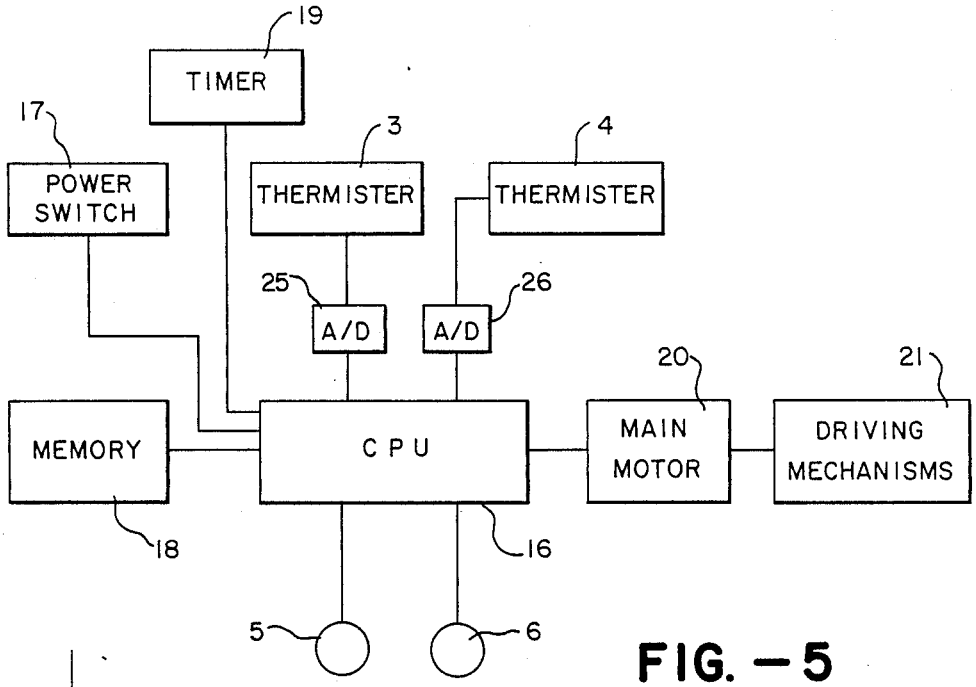
FIG. 5 is a block diagram of a control system for operating the fixing means of FIG. 1 according to another embodiment of the present invention.

FIG. 5 is a block diagram of a control system for operating the fixing means of FIG. 1 according to the second embodiment of the present invention described above. Reference being made to FIG. 5 wherein components corresponding to those defined in connection with FIG. 4 are indicated by the same numbers, a central processing unit CPU 16 is connected not only to the thermister 3 for the heat roller 1 through an analog-to-digital converter 25 and the heat generating means 5 inside the hat roller 1 but also to the thermister 4 for the contact roller 2 through another analog-to-digital converter 26 and the heat generating means 6 inside the contact roller 2. Numeral 18 again indicates a memory means and three values $a_1$, $a_2$ and $b_3$ are stored therein. As explained above, the values $a_1$ and $a_2$ are for making comparisons with the surface temperature of the heat roller 1 and the value $b_3$ is for comparing with the surface temperature of the contact roller 2. The heat generating means 5 and 6 and the main motor 20 are switched on and off in accordance with the results of such comparisons as explained in detail above.

Figure 6:
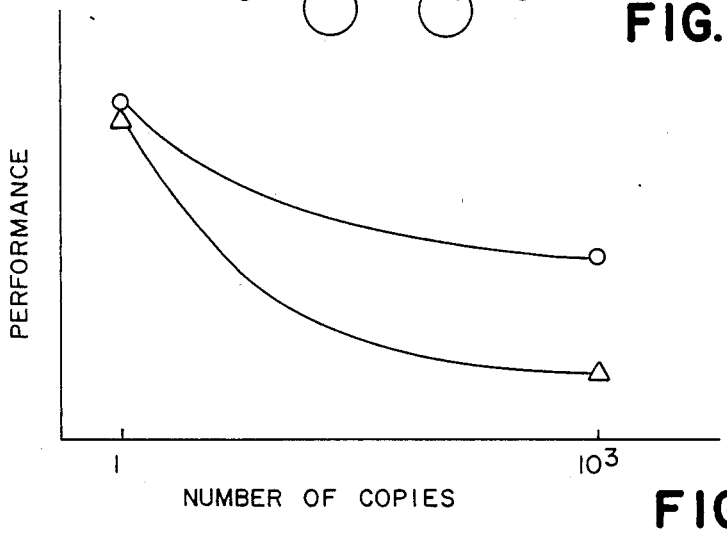
FIG. 6 is a graph which shows the improved performance characteristics of the fixing means of FIG. 1 according to another embodiment of the present invention.

The effects of the third preheating stage according to the second embodiment of the present invention explained above are demonstrated in FIG. 6. The curve between two circles in FIG. 6 represents the relationship between the fixing performance and the number of processed copy papers according to this embodiment of the present invention. The curve between two triangles represents the relationship when a prior art method of operation is used.

Figure 7:
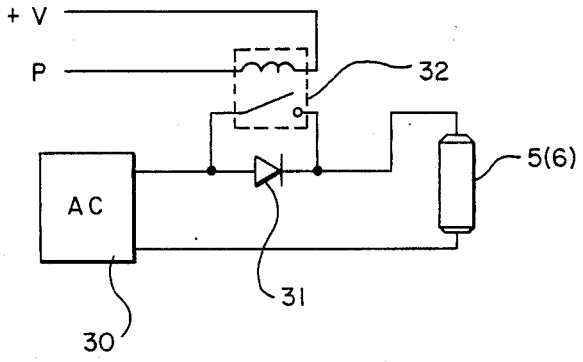
FIG. 7 is a circuit diagram of a circuit for controlling the voltage to be applied to the heat generating means shown in FIG. 1.

The present invention is addressed also to the problem of temperature variations along the width of the rollers when a paper of less than the maximum admissible width is passed between them. As shown in FIG. 7 which is a circuit diagram of a circuit for controlling the voltage to be applied to the heat generating means 5 or 6 of FIG. 1 according to the present invention, each of the heat generating means 5 and 6 is connected to an AC power source 30 through a diode 31. A lead switch 32 which opens and closes in response to a signal P is connected in parallel with the diode 31.

The signal P for opening and closing the lead switch 32 is indicative of the size of a copy paper, or it is a signal which is obtained on the basis of the detected size of a copy paper. For example, if it is determined that a paper of the maximum size is being passed through, the lead switch 32 is closed by a detection signal indicative of this determination and if it is determined that a smaller paper is being passed through, the lead switch 32 is opened by a different detection signal indicative of this finding. It may be preferable to use for the size detection the size-indication signal at the time of copying operation.

Figure 12:
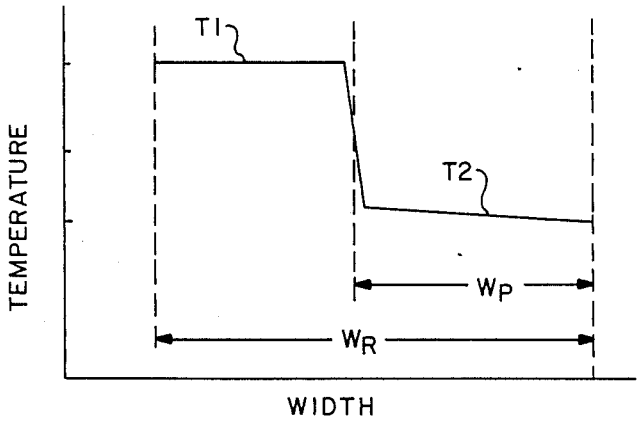
FIG. 12 is a graph showing the temperature distribution on the roller surfaces.
Figure 8:
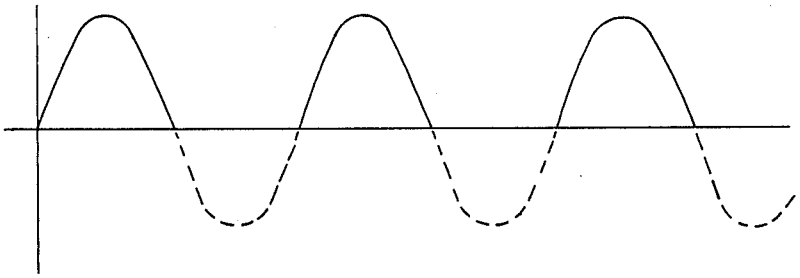
FIG. 8 is a voltage waveform obtained by the circuit shown by FIG. 7.

Thus, when a copy paper 12 of the maximum size carrying unfixed toner images 13 is passed between the rollers 1 and 2 as shown in FIG. 1, the signal P of paper size detection causes the lead switch 32 to close so that a voltage with a waveform obtained by full-wave rectification is applied to the heat generating means 5 and 6 and the toner images 13 are fixed with the amount of heat suited for processing a paper of the maximum size. When a copy paper 12 is of a smaller size, the lead switch 32 is opened by the signal P for paper size detection and a voltage of a waveform obtained by half-wave rectification shown by FIG. 8 is applied to the heat generating means 5 and 6 to heat the rollers 1 and 2. The amount of heat generated under this condition is naturally less although it is still sufficiently large for fixing a paper of a smaller size. Accordingly, the surface temperatures of the rollers 1 and 2 become lower than when a paper of the maximum size is processed. With reference to FIG. 12, this has the effect of reducing the temperature $T_1$ where the paper has not passed and hence the difference $T_1-T_2$.

Figure 9:
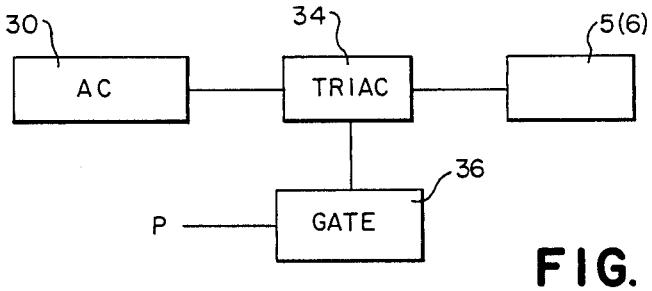
FIG. 9 is a circuit diagram of another voltage control circuit which may be used to control the amount of heat generated by the heat generating means of FIG. 1.
Figure 10:
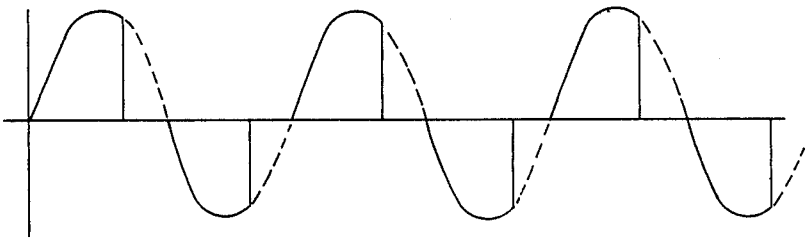
FIG. 10 is a voltage waveform obtained by the circuit shown by FIG 9.
Figure 11:
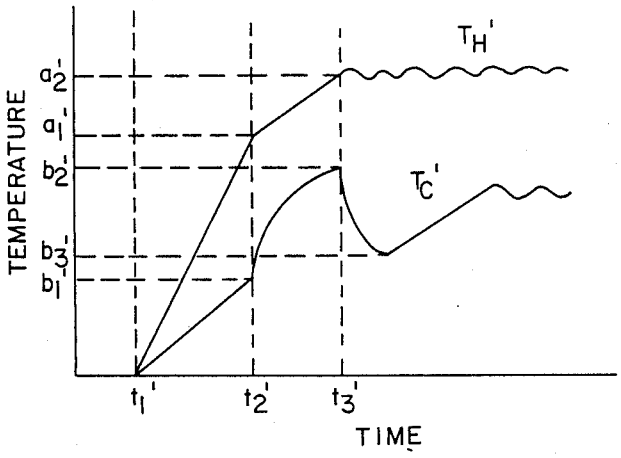
PRIOR ART FIG. —11
FIG. 11 is a graph which schematically shows how the surface temperature of the rollers in a prior art fixing means vary with time.

FIG. 9 is a circuit diagram of another voltage control circuit for controlling the amount of heat generated by the heat generating means 5 and 6. In this circuit, a triac circuit 34 is inserted between the AC power source 30 and the heat generating means 5 (or 6) such that the triac circuit 34 is controlled by the output of a gate circuit 36 which introduces the signal P of paper size detection. Since the phase angle of the voltage can be varied freely with a circuit thus structured, the amount of heat generated by the heat generating means 5 and 6 can be controlled more finely according to the size of the copy paper being processed and the temperature difference $T_1-T_2$ on the rollers 1 and 2 can be reduced most effectively.

In summary, the present invention teaches to control the amount of heat generated inside the rollers for a fixing means according to the detected size of the copy paper being processed. This has the desired effect of improving the lifetimes of the rollers and the quality of copies produced by the fixing means employing them.

The foregoing description of a preferred embodiment of the invention has been presented for purposes of illustration and description. It is not intended to be exhaustive or to limit the invention to the precise form disclosed, and obviously many modifications and variations are possible in light of the above teaching. For example, the end of the third preheating stage need not be defined in either of the manners described above. Reference being made again to FIG. 2, the time to end the preheating process may be chosen at $t_5$ corresponding to the point where the extension of the line representing $T_C$ between $t_1$ and $t_2$ crosses the extension of the same curve representing $T_C$ between $t_3$ and $t_4$. As another example, the first and second stages may be combined into a single stage. In this situation, both heat generating means 5 and 6 are switched on and the main motor 20 remains stationary until the surface temperature of the heat roller 1 reaches the level $a_2$. Such modifications and variations which may be obvious to a person skilled in the art are intended to be within the scope of the present invention.

What is claimed is:

1. A fixing means for a copier comprising a first roller, a second roller adapted to become compressed against said first roller and to thereby receive heat from said first roller, said first roller and said second roller serving to fix toner images on an image transferring medium, means for measuring surface temperatures of said first and second rollers, heating means for independently heating said first roller and said second roller, and a control means programmed to initially operate said heating means to heat both said first and second rollers until a first point in time when the surface temperature of said first roller reaches a first predetermined temperature level which is appropriate for fixing, to begin to rotate said rollers and stop heating said second roller by said heating means at said first point in time, to thereafter continue to rotate said rollers while continuing to heat said first roller by said heating means until a second point in time when the surface temperature of said first roller reaches a second predetermined temperature level which is higher than said first temperature level, and to thereafter alternately stop and start heating said first roller by said heating means such that the surface temperature of said first roller stays substantially at said second predetermined temperature level after said second point in time.

2. The fixing means of claim 1 wherein said control means includes a central processing unit which serves to cause said rollers to rotate for a predetermined length of time after the surface temperature of said first roller reaches said predetermined temperature level.

3. The fixing means of claim 2 wherein said control means further includes a memory means which serves to store a value indicative of said length of time.

4. A fixing means for a copier comprising a first roller, a second roller adapted to become compressed against said first roller, means for measuring surface temperatures of said first and second rollers, heating means for independently heating said first roller and said second roller, said first roller and said second roller being adapted to be heated by said heating means to serve to fix toner images on an image transferring medium, and a control means for controlling the surface temperatures of said rollers and preventing a sudden drop of surface temperature of said first roller, said control means being programmed to first operate said heating means to heat both said first and second rollers until a first point in time when the surface temperature of said first roller reaches a first predetermined temperature level, to begin to rotate said rollers and stop heating said second roller by said heating means at said first point in time, to thereafter continue to rotate said rollers while continuing to heat said first roller by said heating means until a second point in time when the surface temperature of said first roller reaches a second predetermined temperature level higher than said first predetermined temperature level, to thereafter stop and start heating said first roller by said heating means such that the surface temperature of said first roller stays substantially at said second predetermined temperature level after said second point in time, and to thereafter stop rotating said rollers when the surface temperature of said second roller reaches a third predetermined temperature level.

5. The fixing means of claim 4 wherein said control means includes a memory means which serves to store values indicative of said first and second predetermined temperature levels.

6. The fixing means of claim 4 wherein said control means includes a central processing unit which serves to compare surface temperatures of said rollers with said predetermined temperature levels.

* * * * *